US007387051B1

(12) United States Patent
Chiang

(10) Patent No.: US 7,387,051 B1
(45) **Date of Patent: *Jun. 17, 2008**

(54) TOOL DEVICE FOR DRIVING VARIOUS TOOL MEMBERS

(75) Inventor: Wen Hung Chiang, Taichung Hsien (TW)

(73) Assignee: Hsin Ying Enterprise Co., Ltd., Wantien Tsuen Dadu Hsiang, Taichung Hsien (TW)

( * ) Notice: Subject to any disclaimer, the term of this patent is extended or adjusted under 35 U.S.C. 154(b) by 55 days.

This patent is subject to a terminal disclaimer.

(21) Appl. No.: 11/729,248

(22) Filed: Mar. 27, 2007

(51) Int. Cl.

| | |
|---|---|
| ***B25B 13/00*** | (2006.01) |
| ***B25B 13/16*** | (2006.01) |
| ***B25B 7/04*** | (2006.01) |
| *B25G 1/00* | (2006.01) |

(52) U.S. Cl. ..... 81/124.4; 81/173; 81/403

(58) Field of Classification Search ..... 81/124.4, 81/177.85; 173/132; 403/325

See application file for complete search history.

(56) References Cited

U.S. PATENT DOCUMENTS

| | | | | |
|---|---|---|---|---|
| 1,471,451 | A * | 10/1923 | Crimp | 81/185 |
| 3,262,338 | A * | 7/1966 | Mahall | 76/114 |
| 3,298,261 | A * | 1/1967 | Lynn | 81/185 |
| 5,934,384 | A * | 8/1999 | Wang | 173/132 |
| 6,270,085 | B1 | 8/2001 | Chen et al. | 279/22 |
| 6,637,755 | B2 | 10/2003 | Chen et al. | 279/22 |

* cited by examiner

*Primary Examiner*—Joseph J. Hail, III
*Assistant Examiner*—Alvin J. Grant
(74) *Attorney, Agent, or Firm*—Charles E. Baxley

(57) ABSTRACT

A tool device includes a tool shank having a noncircular engaging hole for slidably receiving a socket member which includes a noncircular bore for engaging with various fasteners, a biasing device may bias the socket member outwardly relative to the engaging hole of the tool shank, and an anchoring device may slidably anchor the socket member to the tool shank. One or more socket members may be replaced with each other and may be selectively engaged into the engaging hole of the tool shank, for receiving and driving various tool members of different sizes or diameters or dimensions.

1 Claim, 4 Drawing Sheets

TOOL DEVICE FOR DRIVING VARIOUS TOOL MEMBERS

BACKGROUND OF THE INVENTION

1. Field of the Invention

The present invention relates to a tool device, and more particularly to a tool device including one or more auxiliary socket members replaceable or changeable with each other for receiving and for driving various tool members of different sizes or diameters or dimensions.

2. Description of the Prior Art

Typical tool devices comprise a tool shank or socket having an engaging hole formed in one end thereof for receiving a tool bit or tool member, and a retaining or anchoring device attached onto the tool shank or socket for detachably securing the tool bit or tool member to the tool shank or socket.

For example, U.S. Pat. No. 6,270,085 to Chen et al. discloses one of the typical chuck devices for tool bits and also comprising a tube having a longitudinal engaging hole formed in one end thereof for receiving a tool bit or tool member, and a retaining or chuck device attached onto the tube for detachably securing the tool bit or tool member to the tube.

However, the longitudinal engaging hole of the tube may be used for receiving a tool bit or tool member of a single size only, and the tube may not be separated or disengaged from the chuck device such that the typical chuck device and the tube may not be replaced or changed with each other and may be used for receiving the tool bit or tool member of a single size only.

U.S. Pat. No. 6,637,755 to Chen et al. discloses another typical chuck device for tool bits and also comprising a socket having a longitudinal engaging hole formed in one end thereof for receiving a tool bit or tool member, and a retaining or chuck device attached onto the tube for detachably securing the tool bit or tool member to the socket.

However, similarly, the longitudinal engaging hole of the socket may be used for receiving a tool bit or tool member of a single size only, and the socket may not be separated or disengaged from the chuck device such that the typical chuck device and the socket may not be replaced or changed with each other and may thus be used for receiving the tool bit or tool member of a single size only.

The present invention has arisen to mitigate and/or obviate the afore-described disadvantages of the conventional tool shanks or sockets or tool devices.

SUMMARY OF THE INVENTION

The primary objective of the present invention is to provide a tool device including one or more auxiliary socket members replaceable or changeable with each other for receiving and for driving various tool members of different sizes or diameters or dimensions.

In accordance with one aspect of the invention, there is provided a tool device comprising a tool shank including an engaging hole formed in one end of the tool shank, and the engaging hole including a noncircular cross section, a socket member slidably engaged into the engaging hole of the tool shank and including a noncircular outer peripheral portion for engaging with the noncircular engaging hole of the tool shank and for allowing the socket member to be rotated or driven by the tool shank, the socket member including a bore formed therein and having a noncircular cross section, a biasing device for biasing the socket member outwardly relative to the engaging hole of the tool shank, and an anchoring device for slidably anchoring the socket member to the tool shank. The tool device may include a number of socket members having noncircular bores for receiving various kinds of fasteners or tool members.

The biasing device includes a spring member engaged into the engaging hole of the tool shank for applying a spring biasing force against the socket member. The biasing device includes a follower slidably received and engaged into the engaging hole of the tool shank and disposed between the socket member and the spring member. The follower includes a cavity formed therein for receiving one end of the spring member.

The biasing device includes a magnetic attractive member attached to the follower and acted with the socket member for attracting the socket member to the follower and for preventing the socket member from being disengaged from the tool shank. The follower includes a space formed therein for receiving the magnetic attractive member.

The anchoring device includes an orifice formed in the tool shank, and a detent received and engaged into the orifice of the tool shank and extended into the engaging hole of the tool shank for engaging with the socket member and for slidably anchoring the socket member to the tool shank.

The socket member includes at least one recess formed in an outer peripheral portion thereof for selectively receiving the detent and for slidably securing the socket member to the tool shank and for preventing the socket member from being disengaged from the tool shank.

The socket member includes at least one stop extended into the recess of the socket member and located at one end portion of the recess of the socket member for engaging with the detent and for slidably anchoring the socket member to the tool shank.

The socket member includes a number of flat surfaces formed in the outer peripheral portion thereof, and the recess is formed and located between adjacent flat surfaces of the socket member.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
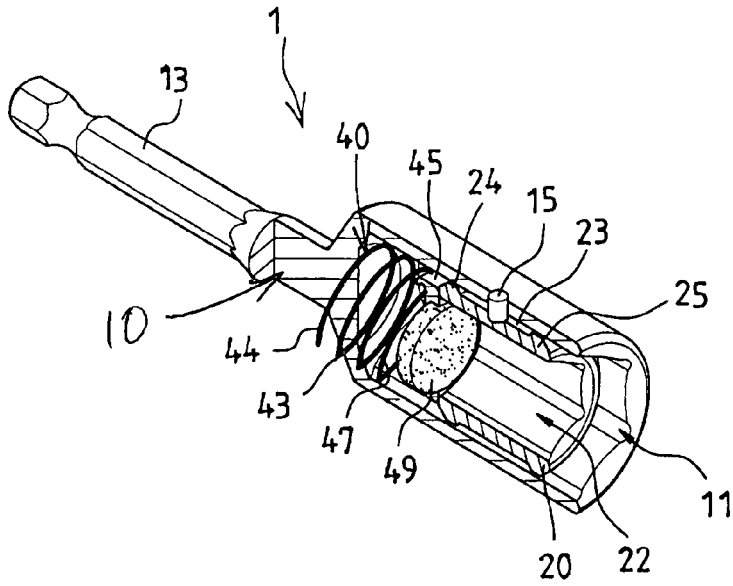
FIG. 1 is a perspective view of a tool device in accordance with the present invention, in which a portion of the tool device has been cut off for showing an inner structure of the tool device.
Figure 2:
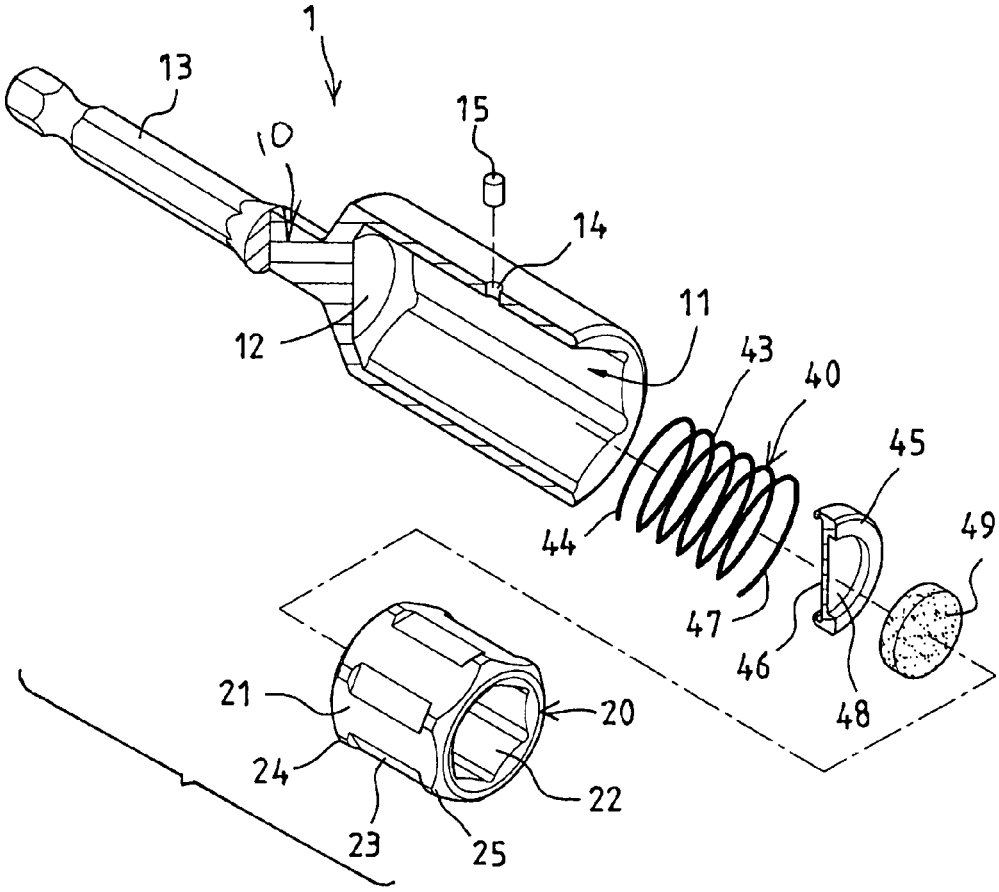
FIG. 2 is an exploded view of the tool device.
Figure 3:
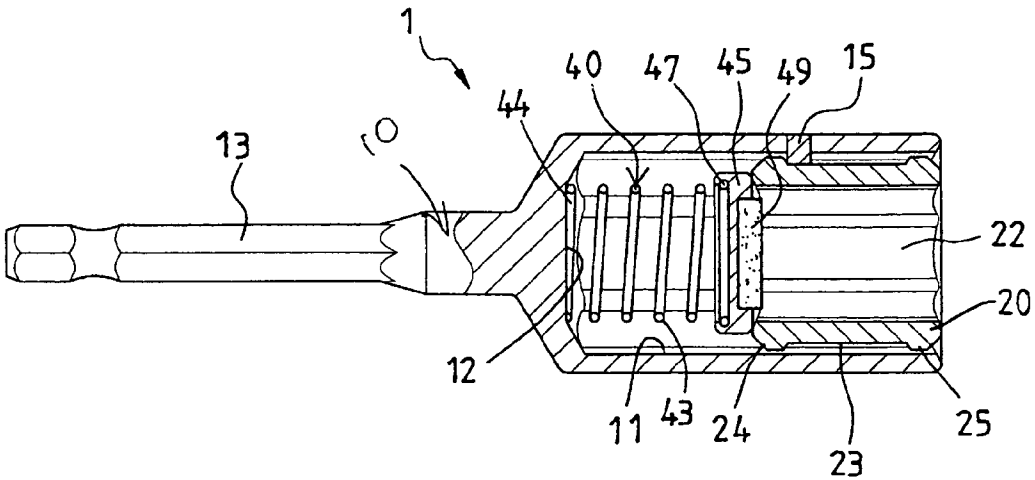
FIG. 3 is a plan schematic view of the tool device, in which a portion of the tool device has also been cut off for showing the inner structure of the tool device.

Referring to the drawings, and initially to FIGS. 1-3, a tool device 1 in accordance with the present invention comprises a socket or tool shank 10 including an engaging hole 11 formed in one end thereof and formed or defined by a bottom or inner or base portion 12 for receiving and driving a tool bit or tool member (not shown), and including a stem 13 extended outwardly from the other end thereof for being engaged with or coupled to the other driving tools and for being rotated or driven by the other driving tools. The engaging hole 11 of the tool shank 10 preferably includes a noncircular cross section, such as square, hexagonal cross section, or the like.

The tool shank 10 further include an orifice 14 formed in the middle portion thereof and formed through the tool shank 10 and communicating with the engaging hole 11 of the tool shank 10 for receiving a peg or key or detent 15, such as a cylindrical detent 15 therein for allowing the detent 15 to be partially extended or engaged into the engaging hole 11 of the tool shank 10 in order to anchor or secure various tool bits or tool members to the tool shank 10. The detent 15 may be secured to the tool shank 10 with such as fasteners or latches (not shown), force-fitted engagements, adhesive materials, or by welding processes, etc.

One or more auxiliary socket members 20 are replaceably or changeably engaged into the engaging hole 11 of the tool shank 10 and each include a noncircular outer peripheral portion having a number of flat surfaces 21 for engaging with the noncircular engaging hole 11 of the tool shank 10 and for allowing the socket members 20 to be selectively or changeably rotated or driven by the tool shank 10. The socket members 20 each include a socket opening or bore 22 formed therein, and the bores 22 of the socket members 20 also include a noncircular cross section, such as square, hexagonal cross section, or the like, and include different sizes or diameters or dimensions for receiving various tool members of different sizes or diameters or dimensions, and for allowing the socket members 20 having different bores 22 to be selectively or changeably rotated or driven by the tool shank 10.

Figure 4:
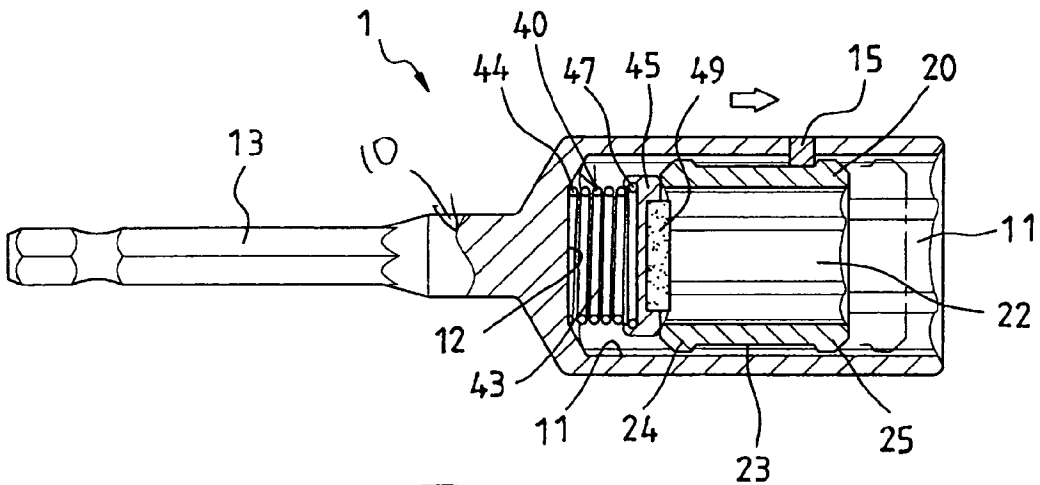
FIG. 4 is a plan schematic view similar to FIG. 3 illustrating the operation of the tool device.

The socket members 20 each include one or more cut off portions or recesses 23 formed in the outer peripheral portion thereof and formed or located between the adjacent flat surfaces 21 of the socket members 20 for selectively receiving the detent 15 (FIG. 3) and for slidably securing the socket members 20 to the tool shank 10; and each include one or more (such as two) projections or stops 24, 25 extended into each of the recesses 23 of the socket members 20 and located at the end portions of each of the recesses 23 of the socket members 20 for engaging with the detent 15 (FIGS. 3, 4) and for slidably anchoring the socket members 20 to the tool shank 10. In operation, as shown in FIGS. 3 and 4, the detent 15 is engaged into the engaging hole 11 of the tool shank 10 and slidably engaged into either of the recesses 23 of the socket member 20 in order to slidably anchor the socket members 20 to the tool shank 10. The detent 15 may thus be formed and acted as an anchoring means or device for slidably anchoring or securing the socket members 20 to the tool shank 10.

A spring biasing means or device 40 may further be provided and engaged into the engaging hole 11 of the tool shank 10, for engaging with the socket member 20 and for biasing the socket member 20 outwardly relative to the engaging hole 11 of the tool shank 10, for example, the spring biasing means or device 40 includes a spring member 43 having one end 44 engaged with the base portion 12 of the tool shank 10, and a slide or follower 45 is slidably received or engaged into the engaging hole 11 of the tool shank 10 and disposed between the socket member 20 and the spring member 43, the follower 45 includes a cavity 46 formed therein for receiving the other end 47 of the spring member 43.

In operation, as shown in FIG. 3, the spring member 43 of the spring biasing means or device 40 may apply a spring biasing force onto or against the socket member 20 in order to bias or force the socket member 20 to move outwardly relative to the engaging hole 11 of the tool shank 10 for allowing the tool bit or tool member (not shown) to be selectively engaged into the bores 22 of the socket members 20 and to be rotated or driven by the socket members 20 and thus the tool shank 10. As shown in FIG. 4, the socket member 20 may also be forced or moved against the spring member 43 and engaged into the engaging hole 11 of the tool shank 10 for allowing the tool bit or tool member (not shown) to be selectively engaged with the engaging hole 11 of the tool shank 10 and to be directly rotated or driven by the tool shank 10.

The follower 45 may be secured to the other end 47 of the spring member 43 with such as a force-fitted engagement, or adhesive materials, or latches or fasteners (not shown), and may further include a space 48 formed therein and formed or provided opposite to the cavity 46 thereof or facing away from the spring member 43 for partially receiving or engaging with a magnet or magnetic attractive member 49 therein which may be simply attached or engaged with or adhered to the follower 45 and which may be engaged with or acted with the socket members 20 for attracting the socket members 20 to the follower 45 and thus for retaining the socket members 20 to the tool shank 10, and/or for preventing the socket members 20 from being disengaged from the tool shank 10.

Figure 5:
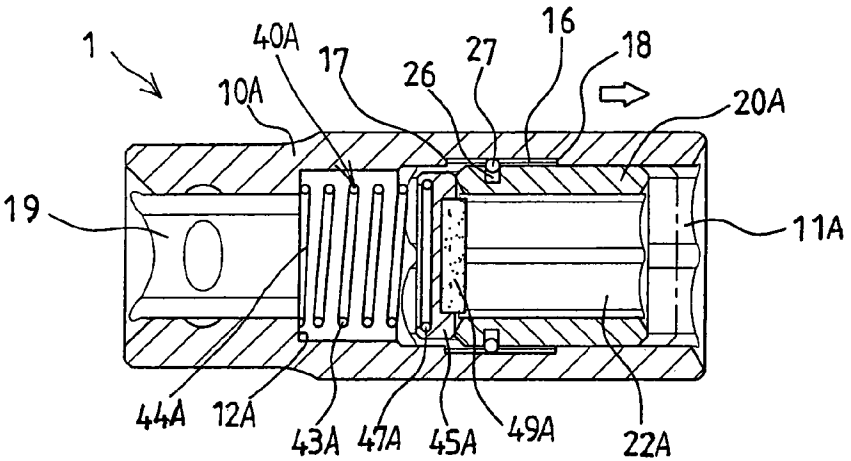
FIG. 5 is a cross sectional view similar to FIGS. 3 and 4, illustrating the other arrangement of the tool device.

Alternatively, as shown in FIG. 5, instead of the detent 15 and the recesses 23 of the socket members 20 as shown in FIGS. 1-4, the socket members 20A each include a peripheral groove 26 formed in the outer peripheral portion thereof for receiving a retaining ring 27 therein which is partially extended out of the outer peripheral portion of the socket members 20A. The tool shank 10A includes a channel 16 formed therein and formed or defined by two end stops 17, 18 for slidably receiving the retaining ring 27, and the retaining ring 27 may be engaged with either of the end stops 17, 18 of the tool shank 10A for slidably retaining the socket members 20A to the tool shank 10A, and/or for preventing the socket members 20A from being disengaged from the tool shank 10A. The socket members 20A also include the bores 22A of different sizes or diameters or dimensions for receiving various tool members of different sizes or diameters or dimensions.

A spring biasing means or device 40A may also be provided and engaged into the tool shank 10A and includes a spring member 43A having one end 44A engaged with the base portion 12A of the tool shank 10A, and a slide or follower 45A is slidably received or engaged into the tool shank 10A and disposed between the base portion 12A of the tool shank 10A and the socket member 20A, and the other end 47A of the spring member 43A is engaged into the follower 45A. The follower 45A may further include a magnet or magnetic attractive member 49A received or engaged into the follower 45A engaged with or acted with the socket members 20A for attracting the socket members 20A to the follower 45A and thus for retaining the socket members 20A to the tool shank 10A, or for preventing the socket members 20A from being disengaged from the tool shank 10A.

Instead of the stem 13 (FIGS. 1-4), the tool stem 10A may include a socket opening 19 formed therein and having a noncircular cross section, such as square, hexagonal cross section, or the like for engaging with a corresponding noncircular driving head (not shown) of a driving tool element (not shown) and for allowing the tool stem 10A to be rotated or driven by the driving tool element.

Figure 6:
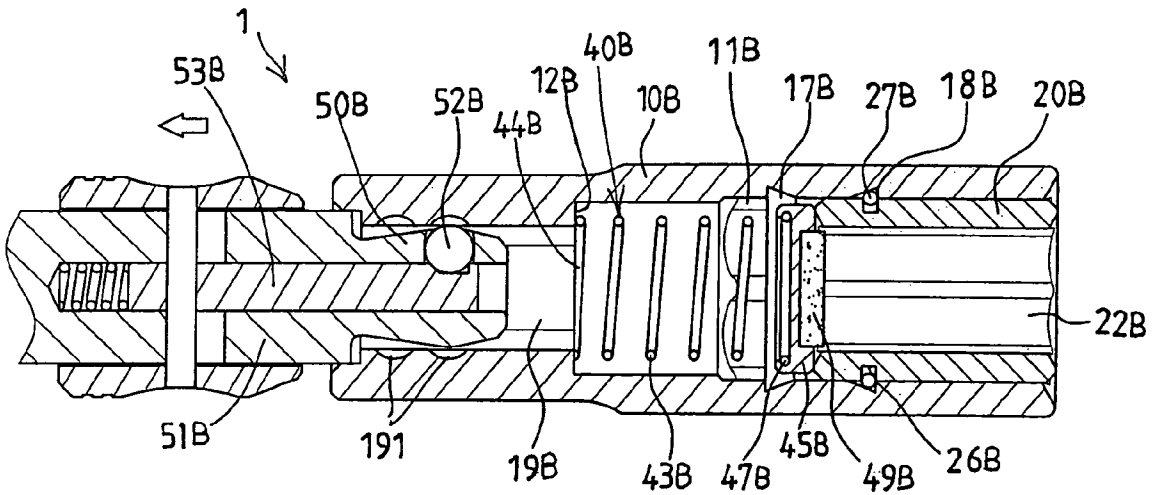
FIG. 6 is a cross sectional view similar to FIG. 5, illustrating the further arrangement of the tool device.
Figure 7:
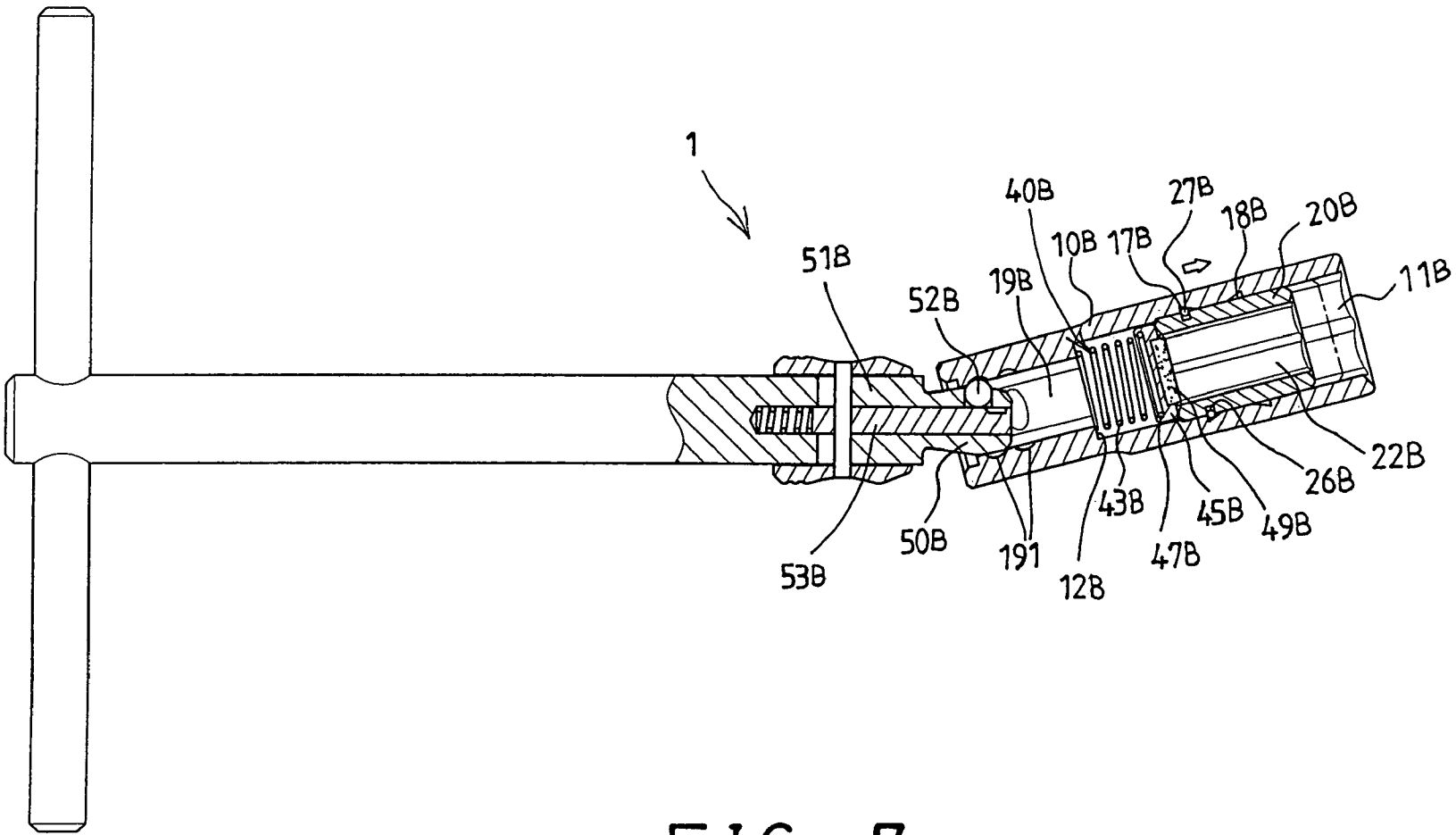
FIG. 7 is a cross sectional view similar to FIG. 6 illustrating the operation of the tool device as shown in FIG. 6.

Further alternatively, as shown in FIGS. 6 and 7, the tool shank 10B also includes a noncircular engaging hole 11B formed in one end thereof and formed or defined by a bottom or inner or opened base portion 12B for receiving and driving various tool bits or tool members (not shown), instead of the channel 16 formed in the tool shank 10A as shown in FIG. 5, the tool shank 10B includes two peripheral and/or ratchet limiting grooves 17B, 18B formed therein and communicating with the engaging hole 11B of the tool shank 10B, and the socket members 20B each also include a peripheral groove 26B formed in the outer peripheral portion thereof for receiving a retaining ring 27B therein which is selectively engageable with either of the ratchet limiting grooves 17B, 18B of the tool shank 10B for limiting the socket members 20B to move or to slide relative to the tool shank 10B and also for preventing the socket members 20B from being disengaged from the tool shank 10B. The socket members 20B also include the bores 22B of different sizes or diameters or dimensions for receiving various tool members of different sizes or diameters or dimensions.

A spring biasing means or device 40B may also be provided and engaged into the tool shank 10B and includes a spring member 43A having one end 44A engaged with the base portion 12A of the tool shank 10B, and a slide or follower 45A is slidably received or engaged into the tool shank 10B and disposed between the base portion 12A of the tool shank 10B and the socket member 20B, and the other end 47A of the spring member 43A is engaged into the follower 45A. The follower 45A may further include a magnet or magnetic attractive member 49A received or engaged into the follower 45A engaged with or acted with the socket members 20B for attracting the socket members 20B to the follower 45A and thus for retaining the socket members 20B to the tool shank 10B, or for preventing the socket members 20B from being disengaged from the tool shank 10B.

Instead of the stem 13 (FIGS. 1-4), the tool stem 10B may include a socket opening 19B formed therein and having a noncircular cross section, such as square, hexagonal cross section, or the like for engaging with a corresponding noncircular driving head 50B of a driving tool element 51B and for allowing the tool stem 10B to be rotated or driven by the driving tool element 51B. The driving tool element 51B may include an actuator 53B for engaging with a detent 52B and for forcing the detent 52B to selectively engaging with the tool stem 10B and to detachably anchoring or securing the tool stem 10B to the driving tool element 51B. The tool shank 10B further includes two or more cavities 191 formed therein for selectively receiving or engaging with the detent 52B and for selectively or detachably and adjustably anchoring or securing the tool stem 10B to the driving tool element 51B.

Accordingly, the tool device in accordance with the present invention includes one or more auxiliary socket members replaceable or changeable with each other for receiving and for driving various tool members of different sizes or diameters or dimensions.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tool device comprising:

a tool shank including an engaging hole formed in one end of said tool shank, and said engaging hole including a noncircular cross section, said tool shank including an orifice formed therein, a socket member slidably engaged into said engaging hole of said tool shank and including a noncircular outer peripheral portion for engaging with said noncircular engaging hole of said tool shank and for allowing said socket member to be rotated or driven by said tool shank, said socket member including a bore formed therein and having a noncircular cross section, said socket member including at least one recess formed in an outer peripheral portion thereof, and including at least one stop extended into said at least one recess of said socket member and located at one end portion of said at least one recess of said socket member, and including a plurality of flat surfaces formed in said outer peripheral portion thereof, and said at least one recess being formed and located between adjacent flat surfaces of said socket member, means for biasing said socket member outwardly relative to said engaging hole of said tool shank, and said biasing means including a spring member engaged into said engaging hole of said tool shank for applying a spring biasing force against said socket member, a follower slidably received and engaged into said engaging hole of said tool shank and disposed between said socket member and said spring member, said follower including a cavity formed therein for receiving one end of said spring member, and said follower including a space formed therein, a magnetic attractive member attached to said space of said follower and acted with said socket member for attracting said socket member to said follower and for preventing said socket member from being disengaged from said tool shank, and means for slidably anchoring said socket member to said tool shank, said anchoring means including a detent received and engaged into said orifice of said tool shank and extended into said engaging hole of said tool shank for selectively engaging with said at least one recess and said at least one stop of said socket member and for slidably anchoring said socket member to said tool shank.

* * * * *